US010012220B2

(12) United States Patent
Matz et al.

(10) Patent No.: US 10,012,220 B2
(45) Date of Patent: Jul. 3, 2018

(54) MAGNETICALLY DRIVEN PUMP ARRANGEMENT HAVING A MICROPUMP WITH FORCED FLUSHING, AND OPERATING METHOD

(75) Inventors: Astrid Matz, Parchim (DE); Sven Reimann, Ludwigslust (DE); Martin Stojke, Buchberg (DE); Gerald Voegele, Sindelfingen (DE); Thomas Weisener, Schwerin (DE)

(73) Assignee: HNP MIKROSYSTEME GMBH, Schwerin (DE)

( * ) Notice: Subject to any disclaimer, the term of this patent is extended or adjusted under 35 U.S.C. 154(b) by 364 days.

(21) Appl. No.: 13/884,088

(22) PCT Filed: Nov. 15, 2011

(86) PCT No.: PCT/IB2011/055108

§ 371 (c)(1), (2), (4) Date: Jul. 19, 2013

(87) PCT Pub. No.: WO2012/066483

PCT Pub. Date: May 24, 2012

(65) Prior Publication Data

US 2013/0294940 A1 Nov. 7, 2013

(30) Foreign Application Priority Data

Nov. 15, 2010 (DE) ..... 10 2010 060 566
Mar. 2, 2011 (DE) ..... 10 2011 001 041

(51) Int. Cl.
*F04B 19/00* (2006.01)
*F01C 21/02* (2006.01)
(Continued)

(52) U.S. Cl.
CPC ..... *F04B 19/006* (2013.01); *F01C 21/02* (2013.01); *F04C 2/086* (2013.01); *F04C 2/102* (2013.01);
(Continued)

(58) Field of Classification Search
CPC ..... F01C 21/02; F01C 21/08; F04B 19/006; F04C 2/086; F04C 2/102; F04C 11/008;
(Continued)

(56) References Cited

U.S. PATENT DOCUMENTS 4,165,206 A * 8/1979 Martin ..... F04C 2/086 417/310
4,329,128 A * 5/1982 Forgues ..... B29C 47/36 418/206.3
(Continued)

FOREIGN PATENT DOCUMENTS

CN 101096948 A 1/2008
DE 10146793 A1 9/2002
(Continued)

OTHER PUBLICATIONS

English translation of SIPO's search report, attached to office action dated May 6, 2015.
(Continued)

*Primary Examiner* — Essama Omgba
*Assistant Examiner* — Connor Tremarche
(74) *Attorney, Agent, or Firm* — Duane Morris LLP

(57) ABSTRACT

A pump arrangement is disclosed including a magnetically drivable micropump for pumping a liquid pumping medium, a bearing carrier as a base part, and an outer magnet and an inner magnet which transmit a torque to the micropump via an axial shaft. Three radial bearing pieces for the rotational mounting (guidance) of the shaft and of the micropump are positioned and fixed in the bearing carrier. The micropump
(Continued)

Figure 1:
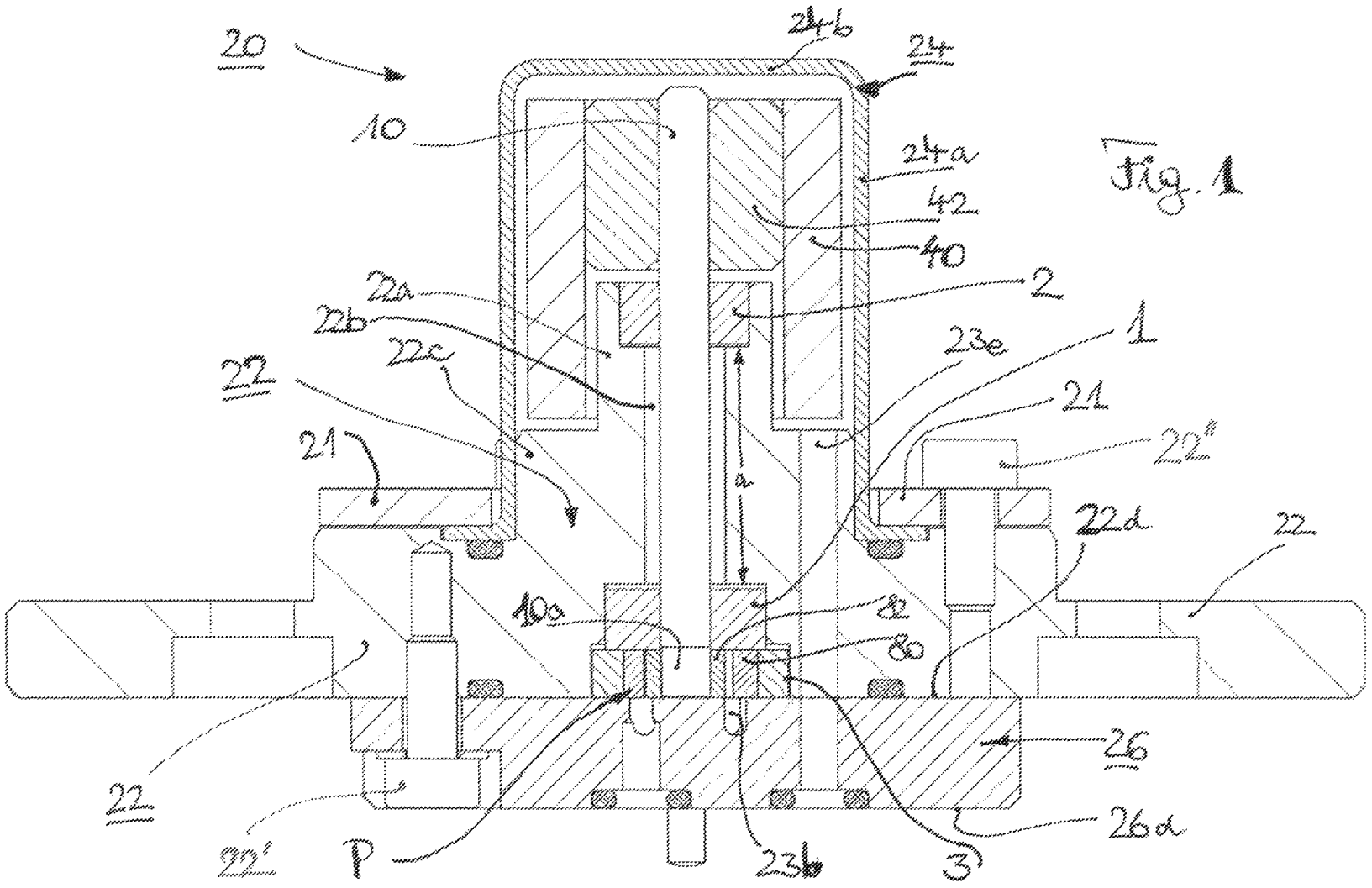

is held in an eccentric bearing by a cover arranged at an end. A duct structure for a forced flow is provided including at least one radial duct portion in the cover and an axial duct portion in the bearing carrier to flush and/or to lubricate the bearings actively with the pumping medium. One of the bearings is arranged closer to the inner magnet and/or another of the bearings is arranged closer to the micropump.

33 Claims, 5 Drawing Sheets

(51) Int. Cl.

| | |
|---|---|
| ***F04C 2/08*** | (2006.01) |
| ***F04C 2/10*** | (2006.01) |
| ***F04C 11/00*** | (2006.01) |
| ***F04C 15/00*** | (2006.01) |

(52) U.S. Cl.
CPC ..... *F04C 11/008* (2013.01); *F04C 15/0069* (2013.01); *F04C 15/0092* (2013.01); *F04C 15/0096* (2013.01)

(58) Field of Classification Search
CPC ..... F04C 15/0069; F04C 15/0092; F04C 15/0096; F04C 11/001; F04C 14/08; B25B 27/06; B29C 47/36; F04D 29/046
USPC ..... 417/423.12, 410.1, 423.7, 410.4; 210/101
See application file for complete search history.

(56) References Cited

U.S. PATENT DOCUMENTS

| | | | | |
|---|---|---|---|---|
| 4,795,796 | A | 1/1989 | Haubennestel et al. | |
| 5,263,829 | A | 11/1993 | Gergets | |
| 5,423,661 | A * | 6/1995 | Gabeler | F04C 14/08 210/101 |
| 5,472,329 | A | 12/1995 | Maynard et al. | |
| 6,033,193 | A * | 3/2000 | Pieters | F04C 15/0069 417/410.4 |
| 6,106,240 | A | 8/2000 | Fischer et al. | |
| 6,179,596 | B1 | 1/2001 | Weisener et al. | |
| 6,186,757 | B1 | 2/2001 | Pippes | |
| 6,520,757 | B1 * | 2/2003 | Erdmann | F04C 2/086 418/171 |
| 8,177,528 | B2 * | 5/2012 | Petersen | F04C 11/001 417/410.1 |
| 2005/0081366 | A1 * | 4/2005 | Voegele | B25B 27/06 29/598 |
| 2005/0214153 | A1 * | 9/2005 | Citro | F01C 21/08 418/140 |
| 2006/0290218 | A1 * | 12/2006 | Shafer | H02K 1/278 310/156.28 |
| 2010/0272592 | A1 * | 10/2010 | Chien | F04D 29/046 417/423.7 |

FOREIGN PATENT DOCUMENTS

| | | | |
|---|---|---|---|
| EP | 0270126 | A2 | 6/1988 |
| EP | 0949419 | A1 | 10/1999 |
| GB | 1243306 | A | 8/1971 |
| WO | 97/12147 | A1 | 4/1997 |
| WO | 00/17523 | A1 | 3/2000 |
| WO | 02/057631 | A2 | 7/2002 |
| WO | 2008/046828 | A1 | 4/2008 |

OTHER PUBLICATIONS

German Examination Report for DE 10 2011 001 041.6, dated Jun. 30, 2011.
International Search Report for PCT/IB2011/055108, dated Apr. 25, 2013.

* cited by examiner 20
10
24b
24
24a
42
40
2
23e
1
21
22''
22d
22
26
26a
3
23b
80
P
10a
22c
22b
22a
22
21
22
22' section III – III
23: fluid pathway
1
2
3
10
22
22'
22a
22b
22c
23a
23b
23c
23d
23e
23f
24
26
FP
FD
FU
A
B
C 96
95
23
45
42
40
44
24
21
22
22''
22'''
22d
26
23e
26d
22'
P
2
4
3
22''
94
20*

MAGNETICALLY DRIVEN PUMP ARRANGEMENT HAVING A MICROPUMP WITH FORCED FLUSHING, AND OPERATING METHOD

CROSS-REFERENCE TO RELATED PATENT APPLICATIONS

The present application is a U.S. national stage application under 35 U.S.C. § 371 of PCT Application No. PCT/IB2011/055108, filed Nov. 15, 2011, the entirety of which is incorporated herein by reference.

The invention relates to a pump arrangement comprising a micropump which can be driven magnetically (claim 1). This micropump works to pump a volume flow of a liquid pumping medium which can be more or less viscous. The invention also relates to an associated method for operating a magnetically driven micropump of this type, which method can draw on the flow of the forced flow, since this occurs only during operation of the micropump (claim 32). Forced flow means the flow of the more or less viscous pumping medium. Finally, the invention relates to a micropump which is adapted to be driven by a magnetic drive, the inner magnet and outer magnet being the magnetic components (claim 20). A particularly distinguished duct structure for said forced flow of the fluid pumping medium is also disclosed (claim 25).

The mounting of said micropumps has proven problematic in the prior art. Micropumps are of an order of magnitude which is scarcely larger than a thumbnail. Dimensions of less than 20 mm, in particular less than 10 mm (maximum for a dimension of the micropump) are given and such pump devices, known as micropumps, have to be mounted appropriately.

Figure 5:
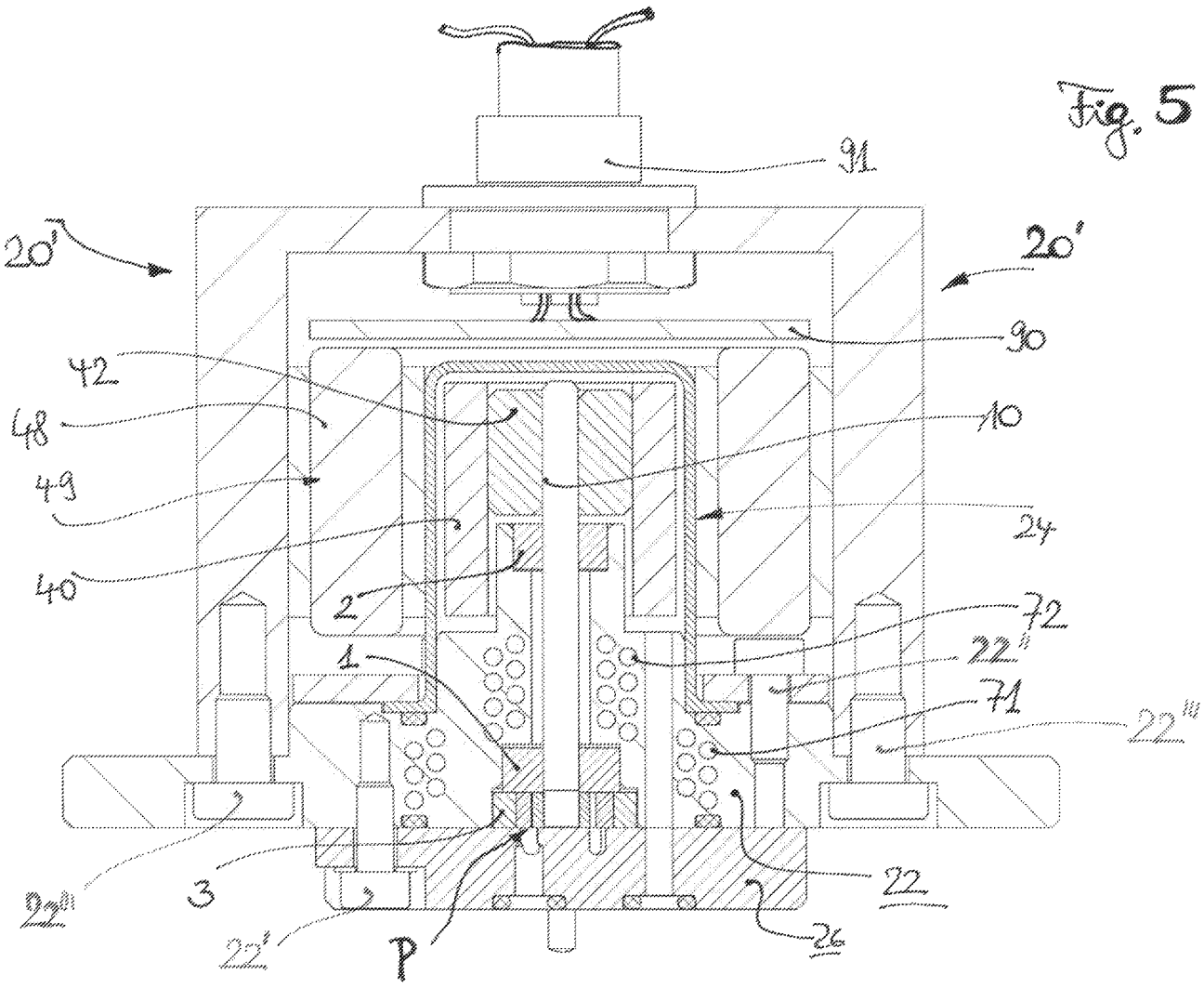

Proposals have been made in the prior art in this respect, cf. WO 02/057631 A2 (HNP Mikrosysteme). In this document, precision bearing components are produced separately and inserted into a less precise carrier or holder. The invention in this document, cf. the first four paragraphs on page 2, refers to an imprecisely produced stator and to simple, precise bushings which are produced mechanically in a precise manner. Said bushings are inserted into said stator and connected thereto by joining (soldering, gluing, force fitting). As a result, it is possible to achieve maximum accuracy at a manageable cost and low vertical range or complexity of production. FIGS. 2 and 5 of this document incidentally show an axial duct portion, 22*b* in this case, which allows fluid to flow back from an intermediate chamber (FIG. 2, between 10 and 24) to the intake side. The duct is provided as an inwardly open stepped hole in the wall 30*i* and connects the intermediate chamber to the intake side in order to recycle fluid back into the microsystem, cf. also paragraph [74].

A technical problem (object) of the invention is to achieve a cost-effective construction of a pump arrangement comprising the micropump and to make do with a minimum number of components, which are of the simplest possible design in terms of production and which can be joined together in a precise manner in terms of assembly. In a particular aspect of the problem, complexity of production is to be replaced at least in part by complexity of assembly, whereby necessary close tolerances are also achieved. These are a sine qua non for microsystems and micropumps. In a further aspect of this problem, the micropump is also to be flushed or lubricated in the bearing region, which is a considerable problem at rotational speeds above 5000 rpm.

As a (first) solution, a pump arrangement is proposed which comprises a micropump which can be driven magnetically (claim 1). It pumps a liquid pumping medium. The micropump is held by a bearing carrier which is referred to as the base part. The magnetic drive takes place from an outer magnet to an inner magnet, and said inner magnet transmits the torque transmitted thereto to the micropump via the axial shaft. The bearing carrier has three bearing pieces inserted therein, which are connected thereto by joining. These "radial bearing pieces" provide the rotational mounting (or guidance) of the axial shaft and also of the micropump. The radial bearing pieces are positioned and fixed in the bearing carrier, one of the three bearings receiving the outer rotor of the micropump in a rotatable manner. This bearing for the outer rotor is arranged eccentrically with respect to the shaft. By contrast, the inner rotor, which is driven by the axial shaft, is arranged centrically with respect to the axial shaft. The pump itself contains the inner rotor and the outer rotor, the two interlocking and rotating together, albeit at different speeds.

The outer rotor is received in the "eccentric bearing" and held therein by a cover at the end. The at least two further bearing pieces are provided for the shaft. One of these bearings is closer to the inner magnet and the other of the bearings (shaft bearings) is closer to the micropump. The two bearings are preferably arranged as far apart as possible, in order to give the axial shaft good stability and concentricity.

Saying that one bearing is closer to the magnet and another bearing is closer to the micropump expresses a relative relationship. Of course, the one bearing can be "close" to the inner magnet, or surrounded by an annular magnet (the radial bearing then has a small radial measurement). This is certainly covered by the definition of the relationship. The other bearing is closer to the micropump and this definition also covers it being arranged close to or at the micropump, or even directly on the micropump for support and mounting at the end. However, what is claimed is not the term "close" but rather a relationship of the bearings to each other with regard to the inner magnet and the pump.

In order to allow flushing or lubrication, a duct structure (or ducting) is provided. This provides a forced flow (during operation). The duct structure has a plurality of portions, at least two of which are to be highlighted. A first duct portion is arranged in the cover. A second duct portion is arranged in the bearing carrier. The ducting within the meaning of the duct system thus makes it possible to divert the fluid pumping medium on the pressure side via the cover and the bearing carrier in order to allow flushing and/or lubrication of all three aforementioned bearings.

A further, independent solution (claim 20) solves the same problems, but with a different type of bearing and bearing carrier. The bearing carrier is produced from metal or plastics material by injection molding. During the injection molding the bearings are formed in the bearing carrier in an integrated manner, and therefore are not separate precision components but rather are produced directly during production of the bearing carrier. They are made of either metal or plastics material. In this context, the resulting at least three axially spaced radial bearings can also be referred to as bearing regions which are formed in one piece with the bearing carrier or are integrated therewith.

They are formed and adapted at two points for supporting the shaft and at one point for supporting the outer rotor and the micropump. This is arranged in a rotatable manner in the eccentric bearing (in relation to the shaft).

This micropump is also driven by an outer magnet which transmits a torque to an inner magnet which has axial spacing from the micropump. This can be regarded as a "magnetic coupling", or as a magnetic torque transmission (claim 2).

In this variant of the invention, too, the pump is held in the eccentric bearing by a cover arranged at the end. In this case, too, the duct structure, as paraphrased above, provides the forced flow, in order to flush and/or to lubricate the bearing actively with the pumping medium (the pumped volume flow).

The two bearings for the shaft have considerable spacing from each other. One bearing is close to, in particular even inside the inner magnet, and is a component of the bearing carrier. The other bearing is close to or directly at the micropump and is a component of the bearing carrier.

In a third aspect of the invention the emphasis is on the duct structure (claim 25), as a result of which the pumping medium pumped by the pump actively flushes or lubricates, specifically the bearings present, of which the claim mentions at least three. Two radial bearings are shaft bearings and one of these bearings is the bearing for the outer rotor of the micropump. At least one duct portion of the duct structure is located in said cover and a further duct portion is located in the bearing carrier and is (also) arranged on the pressure side. Further duct portions can be provided.

In two of the three aspects of the invention (claim 1 and claim 25) the function-determining tolerances are combined in three precision bearings. Important measurements are produced by precise assembly of these precision bearings in relation to each other. After positioning, the precision bearings are connected to the bearing carrier by a joining method (joining technology, claims 7 and 10). For example, gluing, welding or soldering is used in order to meet the high tolerance requirements in terms of assembly. The costs of producing the individual parts can thereby be reduced.

In the aforementioned construction, the number of axial bearings required can also be reduced. The cover which holds the micropump in the eccentric bearing at the end is such an axial bearing. Ceramic material is preferably used in this case, in order to minimize wear. An axial bearing is not required on the side of the shaft at the end of the shaft remote from the rotor (remote from the pump). The forces acting on the shaft are set such that such a bearing can be omitted.

The following forces which can act on the shaft come into consideration. An axial force component of the inner rotor of the pump. However, owing to the close sliding fit (polygon) no axial forces are transmitted to the shaft during rotation of the pump. The magnetic drive (that is to say the torque transmission from the outer magnet to the inner magnet, which is coupled to the shaft for rotation therewith via a bearing carrier) could produce an axial force component. However, when the axial positions of the inner magnet and the outer magnet are matched such that no axial force component is produced, there is also no need for an axial bearing to absorb such a force component in this case. The resulting pressure gradient of the pumping medium inside the housing arrangement formed of the bearing carrier, a hood-shaped cap part placed thereon and an opposing cover (claims 19, 21 and 26) provides a basis for the lack of such a further axial bearing.

Hermetic sealing and a building pressure inside the housing, which is produced by the work of the pump and the duct portions provided for forced flow, are provided. At the end of the shaft remote from the pump—this is the drive or magnet end of the shaft—a building pressure will produce a pressure gradient towards the rotor end of the shaft, whereby the shaft is pushed towards the pump during operation owing to the building pressure gradient. There the cover provides an axial bearing for the pump and for the pump-side end of the shaft. A further axial bearing at the other end of the shaft can be omitted.

It should be mentioned that the shaft must naturally be coupled to the inner magnet for rotation therewith, and this is done via a magnet carrier (claim 6). The magnet carrier and inner magnet are designed to be concentric and the bearing remote from the pump is preferably provided centrally with respect to the inner magnet. The outer magnet is preferably concentric with the inner magnet, outside the hood-shaped cap, which is also referred to as a separating can.

Components susceptible to failure can preferably become dispensable owing to the construction (claims 19, 22 and 27). Dynamic seals or shaft seals are such components. Owing to the fact that the pump on the one hand is hermetically sealed by the cover and has its seat in the bearing carrier, and the bearing carrier on the other hand has, opposite the cover and concentric with the shaft, a hood-shaped cap as a separating can which is also connected to the bearing carrier via static seals, the hood region can receive the inner magnet, and the fluid pumping medium which exits on the pressure side of the rotating pump via the aforementioned duct portions can flow through the hood region in its entirety. As a result, the hood (hood-shaped cap) can also be cooled from the inside.

Owing to the hermetic construction comprising only static seals (separating can with respect to the bearing carrier and cover with respect to the bearing carrier), the micropump can also pump hazardous media, crystallizing media or volatile media.

Long-term applications are also made possible when the aforementioned dynamic seals which are susceptible to wear are dispensed with. The result of this is the active flow of the pumping medium through the separating can (the hood-shaped housing part), but with further advantages. The dead volume is minimized and the medium to be pumped (or rather, the pumped medium) is simultaneously used to cool the separating can, the bearing surfaces and the magnets, and also to lubricate the bearing surfaces.

The above-paraphrased force effect owing to pressure difference (pressure gradient) is a further advantage which results. A flushing flow which passes through the bearing components of the shaft can be produced along the shaft owing to the provided pressure difference between the region of the separating can (or rather, the region of the inner magnet) and the rotor-side end of the shaft.

The shaft is still mounted in the bearing components, but rotates in a cavity between the bearing components, through which cavity the axial flushing flow passes.

The solution according to the invention which uses integrated bearings in the bearing carrier (claim 20) allows at least the duct structure and the forced flow for cooling, flushing and lubricating the bearing points.

The use of a static drive comprising a stator which produces a rotating magnetic field without having rotating components means that there is a minimal space requirement. In such an application the separating can may be omitted and an external housing is used. An electrical connection which powers the stator for formation of the rotating magnetic field and for transmission to the inner magnet, which is coupled to the shaft for rotation therewith via the magnet carrier, can be introduced through an opening in a hermetically sealed manner.

The inner magnet and the outer magnet then each become inner magnets located inside the surrounding housing. They are differentiated as stator and rotor. The outer magnet produces a rotating magnetic field and remains static. The inner magnet rotates the shaft and is located inside the outer magnet.

This type of drive has a minimal space requirement, but when the hood-shaped housing part (the separating can) is omitted the drive winding of the outer magnet should be coated in order to have resistance with respect to the pumping media and to allow long-term applications.

In addition, in the case of a stationary stator (with a rotating magnetic field), the hood-shaped housing part (or cap) need not be omitted but can also be present. Owing to the material used (usually metal), eddy currents which lead to heat development cannot be avoided in this separating can. However, such heat development is counteracted by the internal cooling over a very large inner surface of the separating can. In a preferred embodiment, over 50%, usually substantially more, of the inner surface of the cap can be cooled (claim 28). A remainder is used to connect the cap to the bearing carrier in a centering manner.

In one option the first solution is configured such that the bearing carrier is produced from metal or plastics material by injection molding (claim 8). Nevertheless, the radial bearing pieces are still produced separately and in the form of precision bearing parts (claim 10). They are subsequently placed in the injection-molded bearing carrier and positioned and fixed, for which purpose a joining method can be used in order to arrange the radial bearing pieces reliably and accurately in the bearing carrier.

Another option and preferred design in the first solution is the presence of a heating element which is to be arranged in an injection-molded bearing carrier (claim 9). Said heating element heats the still not very liquid or scarcely liquid pumping medium in order to improve the cold start capability of the micropump.

To paraphrase the concept of the micropump, reference is made to claim 14. This is drawn on for support at this point in relation to the inventions (claims 1, 20 and 25) and specifically each of the inventions separately. In relation to the cooling capacity of the hood-shaped cap, a large inner surface is understood in the sense that it is at least 50% of an entire inner surface of the cap (claim 28). However, preferably more than 70% of the entire inner surface of the cap can be cooled. In the embodiment comprising a stationary stator which produces a rotating field, the hood-shaped cap can be omitted and another, hermetically sealed housing placed on the bearing carrier. Since no mechanical rotations have to be coupled into the housing formed in this way, but rather only current is supplied via electrical lines, the inner rotor and outer rotor are located together in a housing formed in such a manner.

In the context of a second solution (claim 20), the bearing carrier is produced from for example a thermosetting polymer by injection molding. A heating coil—as an example of a heating element (claim 21)—can be integrated. The cold start capability of the pump can be improved or even facilitated by heating the pumping medium. Heating takes place beyond the solid-liquid phase transition.

The compact construction in all three aspects of the invention (three solutions) provides short tolerance chains and short non-positive connections. The precise bearing pieces (claim 1 and claim 25) meet the requirements in terms of low tolerances for the reliable functioning of the micropump and for use in long-term applications.

Virtually (or almost) all types of fluid pumping medium can be pumped using the pumps described (claim 5): particularly hazardous media, crystallizing media, for example urea, or volatile media, for example methanol, and in the case of the preferred use of a heating element also media which cannot be pumped when cold, for example urea, water or methanol (for example in a motor vehicle).

The torque transmission of the outer magnet and the inner magnet (claim 2) can preferably be designed as a central rotary coupling (claims 3 and 11).

The magnetic field produced by the outer magnet can be produced by a stator (claim 4). In this context the hood-shaped housing part can be omitted.

An internal annular gear pump can be used as a micropump (claim 5), cf. WO 97/12147 A. The shaft is connected to the inner rotor for rotation therewith and also to the magnet carrier and the inner magnet mounted thereon for rotation therewith. Alternatively, an internal gear pump having involute toothing is used.

The inner magnet can consist of one or more parts (claim 13). It is arranged on a carrier (claim 6). Preferred materials for the inner magnet are hard ferrite or relatively high-grade magnetic materials. In the case of a multi-part inner magnet, a plurality of individual magnets arranged in a ring can be placed side by side. If only one inner magnet is used, an annular magnet can preferably be used. "Plate-like" magnets (as magnetic pieces) made of relatively high-grade magnetic material, for example NdFeB (as an example of a rare earth magnet) or SmCo (samarium-cobalt) can also be combined as segments to form an annular inner magnet.

Examples of such segments are the above-mentioned ring segments, which together (placed side by side) produce the annular magnet as an inner magnet. In the example, orders of magnitude of 2 mm in size (thickness, measured radially) and up to 10 mm in height (measured axially) are possible.

Encapsulation or coating of this magnet (in one or more parts) is recommended for pumping of corrosive pumping media (claim 13).

The duct structure which—branching from the pressure side of the micropump (claims 1, 20 and 25)—provides the forced flow has at least two duct portions. One is located in the cover (preferably with a radial direction component) and another is located in the bearing carrier (preferably with an axial direction). In this bearing carrier there can also be a further duct portion (claim 15), which also extends axially but through which the pumping media flows in the opposite direction (claim 16). At the point where the flow direction changes, that is to say between the two axial duct portions, there is a planar, preferably annular receiving space which is formed axially between a lower end of the inner magnet and an upper surface of the bearing carrier (claim 18). Fed from the pressure side of the micropump, the housing fills almost completely starting from this duct portion at the pressure level of the output side of the micropump. The separating can serves as a limiting wall.

The additional axial duct portion in the bearing carrier delivers the pumping medium to the outlet. In this case, yet another axial duct portion is preferably provided (claim 17) which extends in the cover and forms the pressure-side outlet. The above-mentioned first duct portion in the cover is a radially directed duct portion from the pressure side of the micropump.

In accordance with the hood-shaped design of the separating can, the bearing carrier has, around the axis, a concentric elevation or extension (claim 29) which preferably carries at its end the first bearing, opposite which the magnet carrier is located and is attached to the shaft for rotation therewith. Via a reduced radial measurement of the elevation or extension, an annular space is formed peripherally (claim 30), into which a significantly longer inner magnet can be axially inserted, the axial length of which is longer than that of the magnet carrier.

Use of the elevation or extension makes it possible to select the maximum spacing of the two bearing pieces which form the shaft bearing assembly.

With regard to the forced flow of the pumping medium, it can be noted that the intake-side opening in the housing cover is located similarly to the pressure-side outlet. Only the inlet is aligned with the micropump. The outlet is radially offset from the micropump. The axial duct portions in the bearing carrier preferably also have a peripheral offset from each other (claim 31).

Via such a fluid guidance system fluid can flow actively through all regions of the pump and the dead volume of the pump is limited. The pressure difference formed in the hood shaped cap in relation to the micropump in the intake region provides an axial flushing flow along the shaft. This axial flushing flow as the "forced flushing" also provides lubrication of the shaft bearings. The forced flow from the micropump provides cooling of the hood shaped cap (in German "Spalttopf") if such one is provided.

Embodiments of the invention will be described with reference to the following figures. These will deepen and increase understanding of the invention(s).

FIG. 1 is a vertical section through a first example of a magnetically drivable pump arrangement comprising a micropump. The bearing carrier 22 is the center of the construction; above is a hood-shaped housing portion 24 and below is a cover 26 which rests in an axially bearing manner against the micropump P comprising the outer rotor 80. The hood-shaped housing portion, which hereinafter is also referred to as a separating can or separating cup, is part of a housing 20 which comprises the hood-shaped housing portion 24, a bearing carrier 22 and a cover 26.

FIG. 2 is a view of the cover side (from below in FIG. 1), the directions top and bottom relating merely to the representation in the figures and not being prejudicial to the construction as such in terms of its installation direction. A sectional plane III-III is sketched in FIG. 2 and shown in FIG. 3, the section having three inflections A, B and C which should be taken into account when considering FIG. 3. As a result, the ducting 23, which will be described in more detail below, is clearer in FIG. 3 than it can be shown in FIG. 1, which corresponds to a section III'-III' which has no inflection points but rather extends centrally in a planar manner.

Figure 2A:
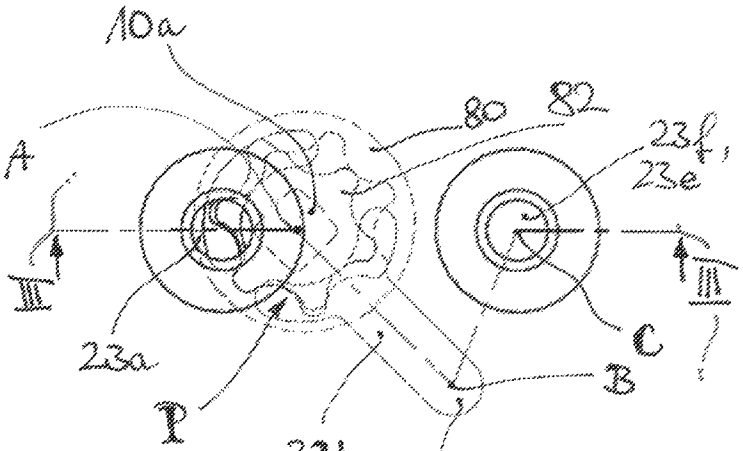
Figure 2:
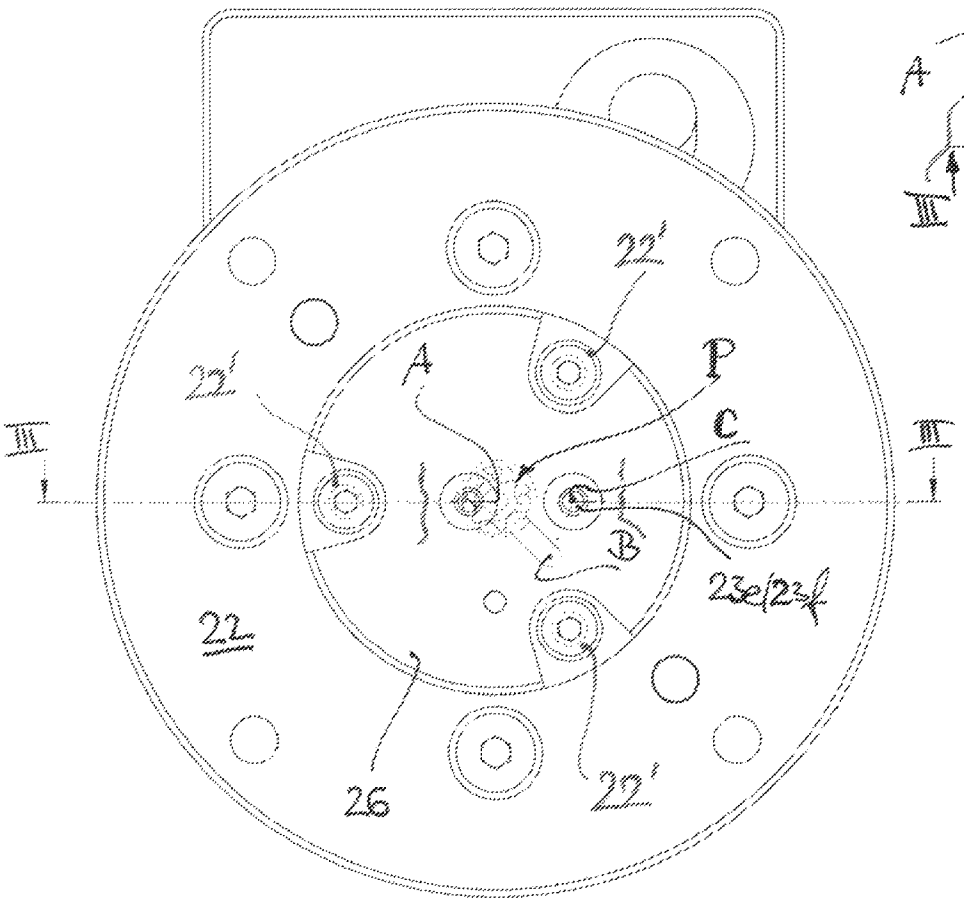

FIG. 2*a* is a detail enlargement of the center of FIG. 2, in order to clarify the statements made with respect to FIG. 2. In particular, the micropump P which comprises an outer rotor 80 and an inner rotor 82 is highlighted here. The shaft 10 as an axial reference of the arrangement interlocks with a polygonal portion 10*a* in a correspondingly formed inner opening of the inner rotor 82, in order to drive said rotor.

Figure 3:
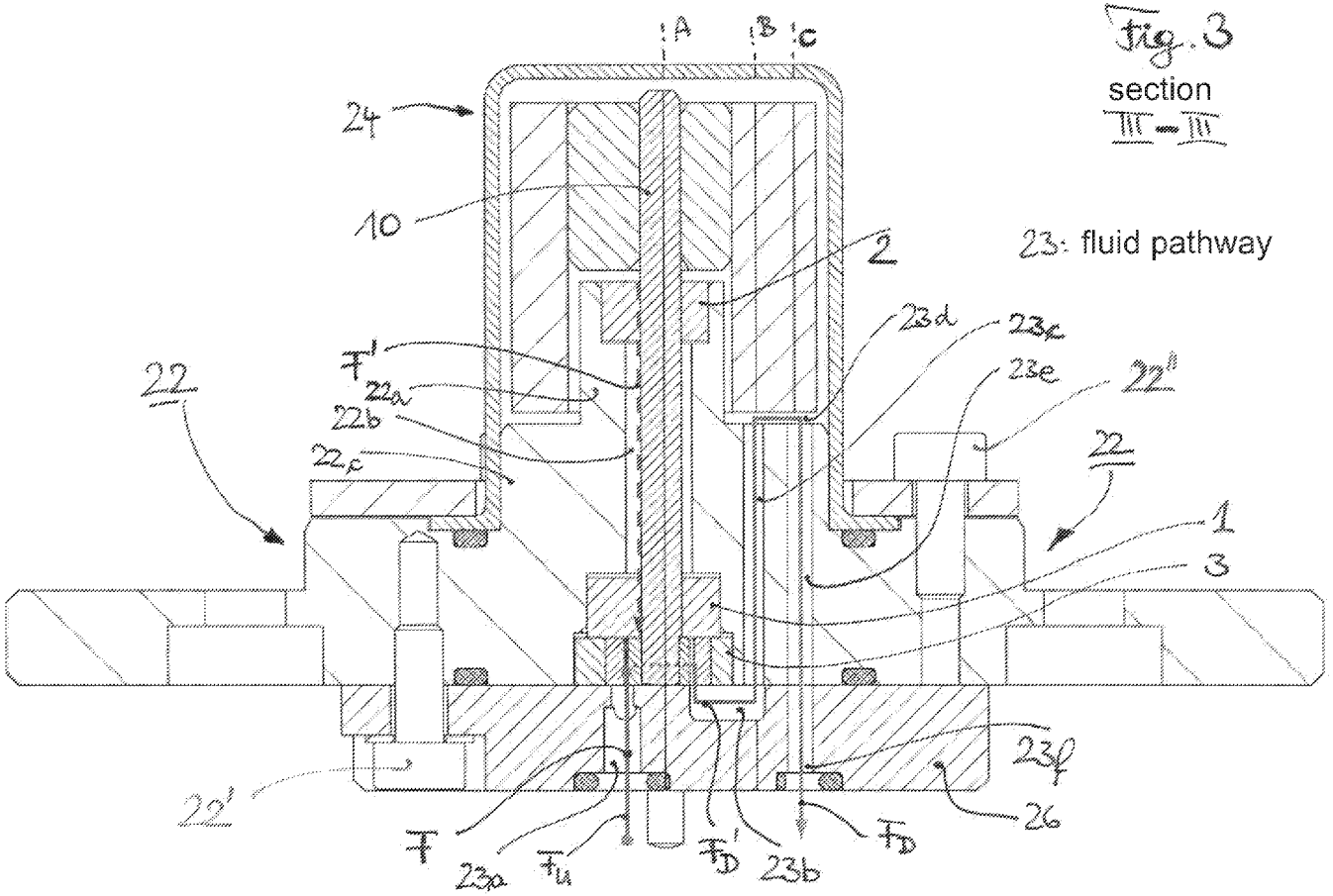

FIG. 3 is the sectional view along the line III-III from FIG. 2 and having the inflections A, B and C to be taken into account, as shown therein. In addition, FIG. 3 also shows a fluid guidance system F from the intake side to the pressure side of the micropump, such as a flushing flow F'. The associated duct structure 23 is often used as a synonym for the flow guidance of the liquid pumping medium which follows the duct structure 23. The duct structure 23 consists of a plurality of portions which will be described.

Figure 4:
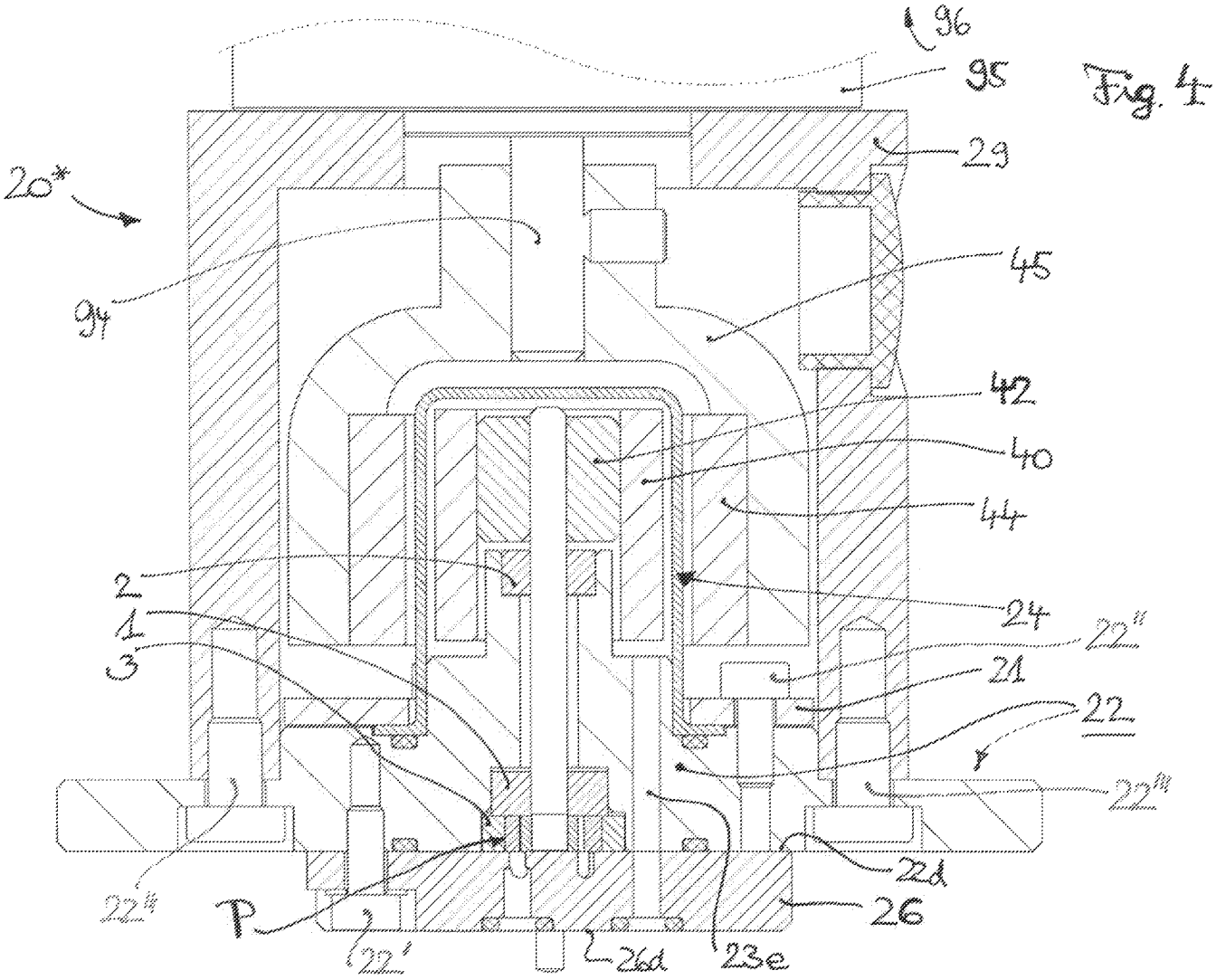

FIG. 4 is a further embodiment of how the arrangement according to FIGS. 1 and 2 is inserted into a housing 20* and driven by a drive motor 95 via a rotatable outer magnet 44. The shaft 10 and the hood-shaped portion 24 of the in this case inner housing 20 serve as a reference.

FIG. 5 is a further embodiment comprising a stationary stator magnet 48 which can produce a rotating magnetic field and drives the inner magnet 40 upon transmission of a torque. Owing to the electrical production of the rotating field, access to the modified housing 20' is achieved via a connection plug 91 which does not need to convey a rotatable shaft into the housing 20' from the outside. An integrated heater 71, 72 of a particular design is also shown.

A liquid pumping medium (not shown physically), which can have different material compositions but is suitable for pumping by a micropump, is to be pumped. For automotive construction this is for example urea, water or methanol. Hazardous media, for example in chemistry, crystallizing media, for example the above-mentioned urea in automotive construction, or volatile media, for example methanol in fuel cell technology, can equally be pumped using the embodiments described below.

The pumping is continuous pumping while the micropump P, which is inserted in a bearing 3 which is referred to as a rotor seat in FIG. 1, is in operation.

FIG. 1 shows as a central component a shaft 10 which is arranged in the axis of the construction. It is rotatably mounted in two further bearings 1 and 2, the two bearings having a spacing 'a' from each other.

All three said bearings 1, 2 and 3 are designed as bearing pieces which are precision bearing parts. They are inserted separately into the bearing carrier 22 and fixed there by means of a joining technology after positioning. Gluing, soldering or welding are suitable joining technologies.

Oxide ceramics, non-oxide ceramics, metal or even plastics material are possible materials for the precision bearings, which are produced separately to precision. Examples of oxide ceramics are aluminum oxide or zirconium oxide. In a particular configuration, in the case of expected high wear or when a long service life is desired, ceramics are used. In normal applications with relatively low wear, metal can be used. Plastics material is also a possibility for the bearings, which in the case of a one-piece design of the bearing carrier 22 are preferably produced by injection molding directly with the production of the bearing carrier 22 as plastics material bearing regions, but are not separate bearing parts but rather only bearing regions or, in functional terms, "bearings".

The construction of the housing 20 in FIG. 1 comprises firstly the following three components: hood-shaped cap 24, bearing carrier 22 and cover 26. The bearing carrier is designed such that it receives the three aforementioned radial bearings 1, 2 and 3 and represents the core piece of the magnetically driven micropump and of the associated housing construction. The bearing carrier can have relatively wide tolerances and be made of less solid materials, for example aluminum or plastics material. The precision and accuracy to be obtained are achieved by installing the bearing pieces which are connected to the bearing carrier 22 by joining.

The bearing carrier 22 also serves to accommodate all the static seals, which are not identified separately in the figures but are immediately clear to a person skilled in the art. These are O-rings and seals for attaching the cover 26, the hood-shaped cap 24 (also referred to as a separating can) and the magnetic drive unit, which can be seen for example in FIG. 4 with its lower portion and a rotatable outer magnet 44.

In FIG. 1, the mounting of the cover 26 from the lower side of the bearing carrier 22 is symbolized by a penetrating screwing device 22'. This mounting can also take place as shown for the mounting of the hood-shaped cap 24 on the other side of the bearing carrier 22, specifically by means of pressure pads 21, via which a mounting force of a further screwing device 22" is uniformly transmitted to the periphery of the lower mounting flange of the hood 24. If the cover 26 is made for example of ceramic material, such an arrangement with pressure pads (not shown separately in FIG. 1) is recommended.

The magnetic drive system is placed inside the hood-shaped cap 24, around the shaft 10 at the upper end. In this case the shaft has an end which is "remote from the pump" or "remote from the rotor", which is also referred to as the "drive-side or magnet-side" end of the shaft 10. The other end 10*a* of the shaft 10 interlocks with the inner rotor 82, as shown in FIG. 2*a*. This is the pump-side end of the shaft 10, which end is supported axially against the cover 26.

The drive takes place from outside (not shown in FIG. 1) and acts as a coupling of a torque, in particular as a central rotary coupling, the inner magnet 40 and an outer magnet 44 or 48 shown in FIGS. 4 and 5 being arranged concentrically with each other. It is possible to speak of a central rotary coupling when the outer magnet and the inner magnet rotate together. They are then arranged concentrically with each other.

The inner magnet 40 is axially longer than a carrier 42 for this inner magnet, which carrier is connected to the shaft 10 for rotation therewith and is also connected to the inner magnet 40 for rotation therewith. This inner magnet carrier is axially shorter and is located at the upper end, not touching but rather leaving a gap, close to the upper wall 24*b* of the hood-shaped cap 24.

An achievable "relatively large" spacing which the two first bearings 1 and 2, provided for the rotary mounting of the shaft 10, have from each other should be mentioned. The lower bearing is located close to the micropump P, actually directly at the micropump P and serves as an opposing axial bearing for the two rotors 80, 82. The axial bearing opposing these rotors is the inner region of the cover 26. An achievable spacing 'a' is more than three times larger than the axial height of one of the two bearings 1, 2.

The bearing 2 remote from the pump is placed on an elevation or extension 22*a* arranged concentrically with the hood-shaped cap. At its (upper) end said elevation or extension carries said bearing piece 2 and leaves an annular gap in relation to the inner magnet carrier 42. The elevation or extension is also designed geometrically such that it forms a cylindrical annular gap in relation to the inner magnet 40. The inner magnet 40 in turn has axial spacing to leave an annular space 23*d* which forms a portion of a duct structure 23, which will be described in more detail below.

Since the inner magnet 40 also leaves a cylindrical annular gap in relation to the inner surface of the hood-shaped cap 24 (separating can), a fluid can flow through the entire interior of this hood-shaped cap provided that no above-described geometric parts are placed there. In particular, an inner wall of the hood-shaped cap 24 should be mentioned, which inner wall can be cooled by a fluid flow which will be described below, for which purpose the aforementioned annular gap is provided outside the inner magnet 40.

The shaft 10 has, between the two bearing pieces 1, 2, an annular space 22*b* which is radially larger than a diameter of the shaft 10.

The shaft 10 is arranged centrically with respect to the hood-shaped cap 24, while the rotor seat as bearing piece 3 is arranged eccentrically. This bearing piece 3 receives the outer rotor 80 mounted eccentrically with respect to the centrically rotated inner rotor 82.

FIGS. 2 and 2*a* show the pump P comprising the inner rotor and the outer rotor 80, 82 and also the expansion and tapering of the rotating pumping chambers, typical of an annular gear pump. Alternatively, instead of the annular gear pump according to FIG. 2*a*, an internal gear pump can also be used, which is not shown separately in the figures.

The fluid is supplied (on the intake side) via a duct portion 23*a* (intake side). The outlet of the pump P discharges into a pressure nodule, which can be seen in FIG. 2*a* and transitions into a radial duct portion 23*b*. Said portions 23*a*, 23*b* are portions of the duct structure 23 which guides the fluid from the inlet $F_u$ (intake side) to the outlet $F_D$ (pressure side).

The pressure side $F_D'$ is located at the outlet of the pump P in the radial duct portion 23*b*. A further portion of the ducting 23, which passes through the bearing carrier 22 and—in the example—comprises two axial duct portions 23*c* and 23*e*, is located between $F_D'$ and $F_D$. These two duct portions are shown clearly in FIG. 2*a*. They have a peripheral offset from each other but both extend in the axial direction in the bearing carrier 22.

The axial section in FIG. 3 will be described with reference to FIG. 2. The sectional plane III-III has three inflections or lines A, B and C. A is located in the center of the axis or the shaft 10. The second inflection B is located in the center of the first axial portion 23*c* of the fluid guidance system (the duct structure 23). The second inflection is located in the second axial portion 23*e* of the duct structure 23.

Further axial portions of the duct structure 23 can be found in the cover 26. The portion 23*a* is provided on the inlet side (intake side) of the fluid F. An additional axial portion 23*f* is provided in the cover 26 on the pressure side of the arrangement in FIG. 3.

A further radial portion of the ducting 23 is the transition of the direct pressure outlet of the pump P along the portion 23*b* of the duct structure 23, towards the first axial portion 23*c* in the bearing carrier 22.

By means of the duct structure 23, a forced flow is produced which occurs during operation of the pump P and provides not only useful pumping of the fluid F but also performs a number of functions.

The above-described bearings 1, 2 and 3 are lubricated or flushed, or both. The separating can 24 (as the hood-shaped cap of the housing 20) is cooled from the inside, the cooling surface being at least 50% of the entire inner surface of the hood 24, but preferably over 70%.

This can be seen at a first elevation 22*c* of the bearing carrier 22, which elevation transitions in a tapering manner into the above-described elevation or extension 22*a*. A short distance away the hood 24 abuts against the edge surface and is attached to the bearing carrier 22 by the peripheral pressure pad 21 and accordingly positioned screws, of which one screw 22" can be seen in FIG. 1. Preferably, three such mounting screws can be provided (not shown). Peripheral static seals, which are not given separate reference numerals but can be identified by the hatching, are shown in all the figures.

By means of the axial duct portion 23*c*, the fluid F is supplied on the pressure side as pressurized fluid FD', not directly to the outlet in the cover 26 but first to the above-mentioned annular space 23*d* which is formed between an upper surface of the bearing carrier (extending between the shoulders 22*c* and 22*a*) and a downward facing surface of the inner magnet 40. This portion 23*d* is planar and is part of the duct structure 23.

The axial portion 23*c* guides pressurized fluid to this planar annular space 23*d*, which fluid is distributed into the remaining free spaces inside the "hood" 24 and flows therethrough. It can flow back out via the second axial duct portion 23*e* and be supplied to the outlet side or pressure side of the micropump arrangement comprising bearings according to the figures via the axial duct portion 23*f* in the cover 26.

A large portion of the inner surface of the cylindrical wall 24*a* of the hood-shaped cap 24 can thus be cooled.

Although only the axial duct portion 23*e* of the duct structure 23 in the bearing carrier (on the pressure side) can be seen in FIG. 1 owing to the position of the section, and a duct segment 23*b* actually extending radially cannot be seen in the cover 26, the radial portion 23*b* and the first axial portion 23*c* can be seen in the modified section according to FIG. 2*a*.

In addition to the main flow of the fluid F, a flushing flow F' should also be mentioned. This penetrates the bearing surfaces of the precision bearings along the path F' in FIG. 3. In so doing it flushes the two bearings 1, 2 and, owing to the pressure difference, reaches the pump P on the intake side thereof. Lubrication of the bearings is also achieved.

The flushing flow F' passes along the shaft and into the central cavity 22*b* through which the shaft 10 passes, or in which it rotates, while it is rotatably supported by the two bearing pieces 1, 2, which have a mutual spacing 'a'.

The path along the fluid guidance system 23 will be summarized and described again clearly.

The liquid pumping medium is drawn in on the intake side through the housing cover 26 and fed to the axial duct portion 23*a* in the micropump P comprising rotors 82, 80, or drawn in thereby. It follows the rotating pumping chambers according to FIG. 2*a* of the micropump (also referred to simply as the "pump") and is fed to the pressure-side portion of the fluid guidance system. The pressure-side outlet of the pump P ends in the radial duct portion 23*b*. At the end thereof it is fed to the internal duct 23*c* in the bearing carrier 22 and conveyed into the separating can 24. The fluid flows through this separating can (the hood-shaped cap 24) and reaches the pressure-side opening in the housing cover 26 via a further axial duct portion 23*e*.

An aligned duct portion 23*f*, which is a continuation of the axial duct portion (or duct segment) 23*e*, is provided in the cover 26. By means of this fluid guidance system, fluid flows actively through all regions of the pump, while the dead volume of the pump is limited. The pressure difference between the rotor-side end of the shaft and the drive-side end of the shaft 10 provides forced flushing F' and thus lubrication of the bearings 1, 2 by the liquid pumping medium.

The above-described bypass flow, referred to as flushing flow F', follows the pressure gradient between a pumping pressure in the separating can region (inside the hood 24) and the lower pressure in the region of the rotor bearing assembly (the intake side). The medium flowing through the separating can 24 is simultaneously used to cool the separating can and the inner magnet 40.

Owing to the rotating magnetic field and the mostly metal design of the hood-shaped cap 24, heat is produced via eddy currents, and the fluid flow is used to carry away this heat.

In another embodiment, shown in FIG. 5, the separating can may also be omitted. The hood-shaped cap is shown again in FIG. 5, but can be dispensed with owing to the drive shown therein and can be omitted. This embodiment (not shown) is made possible in that an outer housing 20' is formed which is produced outside the outer magnet 48 and is connected in a sealing manner to the bearing carrier. This can be done via a screwing device, of which two screws 22''' can be seen. The pressure pad 21 and the hood-shaped cap 24 are omitted.

Both the outer magnet 48, which carries current-carrying windings 49 (not shown), and the inner magnet 40 are then arranged in the same space and distinguished by being referred to as outer and inner. Owing to the lack of a rotary movement of the outer magnet 48, the torque is transmitted to the inner magnet 40 via the rotating field.

The electrical energy is supplied via the connection plug 91, which represents an opening in the motor housing 28, which is part of the modified housing construction 20'. An integrated control system 90 on a circuit board is shown and produces the current flows in the spatially distributed windings 49 to produce the rotating field.

In a particular type of embodiment, which need not necessarily apply only to this example, but can also be used for the other examples, a heating winding 72 is arranged around the shaft in the bearing carrier 22. A further heating winding 71 can be located closer to the cover 26 and surround the pump P.

The heating windings 71, 72 are electrically conductive resistance windings to which current is applied. This current can also be supplied via the connection cover 91.

In the other regions of FIG. 5 this example corresponds to the design of that in FIGS. 1 and 2.

The integrated heaters 71 and/or 72, which can be provided individually or in combination, improve the cold start capability of the pump when thick or viscous pumping media are to be pumped which, owing to reduced ambient temperature, cannot yet be pumped, for example in automotive construction.

The heating can be used particularly advantageously in connection with a bearing carrier 22 which is produced by injection molding, for example from metal or plastics material.

FIG. 4 shows a further embodiment which uses the construction from FIGS. 1/3. In this case a motor 95 is shown as a drive on a superordinate housing construction 20*, a motor shaft 94 of which motor engages mechanically in a cover plate 29 of the housing construction 20* and rotates a rotating outer magnet 44 via an outer magnet carrier 45 which opens out radially. Said outer magnet, coupled via a magnetic field and by the hood-shaped cap 24, entrains the inner magnet 40 in rotation and forms a central rotary coupling. The motor 95 is actuated by an electrical control system 96 which is shown in detail in FIG. 2 and is preferably placed at the upper end of the motor 95.

The inner magnet 40 and outer magnet 44 are advantageously concentric with each other and not offset from each other in the axial direction. This minimizes axial forces which can/could act on the shaft 10 via the magnetic field.

The superordinate housing construction 20* is connected mechanically to the bearing carrier 22 in a sealing manner. Again, this can be done by means of a screwing device, of which two screws 22''' can be seen, as also shown in FIG. 5.

Worth noting, in this embodiment too, is the use of only one axial bearing of the shaft 10, namely at the cover 26, and the free end of the shaft close to the upper horizontal wall 24*b* of the hood-shaped cap 24. Also worth noting, not only in this embodiment but also in the other embodiments, is the lack of any dynamic seal, that is to say any shaft seal to be provided to seal in relation to a rotating part.

The lower side of the cover 26 is 26*d* and on this side an inlet and outlet are provided, which in this case are provided with O-ring seals and have a larger diameter than the diameter of the outgoing duct portions.

The lower surface of the bearing carrier 22 is 22*d*. The cover 26 is placed on this surface in order to achieve the axial guidance of the duct portions 23*e* and 23*b* and also to guide the axial portion 23*a* to the intake side of the pump P and also to guide the radial duct portion 23*b* to the pressure-side outlet side of the pump P.

The following can be said with regard to the drive-side magnet constructions comprising the outer magnet 44 and the inner magnet 40, and also applies to the examples in FIGS. 1 to 3.

At the drive-side end of the shaft 10, the inner magnet 40 arranged there via the magnet carrier 42 is preferably in one piece (made from one piece). It can consist of hard ferrite. Another mode of construction is the coating of a plastics-bonded magnetic material around the end of the shaft (in the region of the outer magnet 44) and without a shaft-side magnet carrier. As a further alternative, the inner magnet 40 can be made of a plurality of parts. This plurality of parts is held on the magnet carrier 42. For this purpose a plurality of individual magnets arranged in a ring (as segments or sectors) can be used and is assembled on the magnet carrier 42. If only one piece of a magnet is provided, this sits as an annular magnet on the magnet carrier 42 and is joined thereto for rotation therewith.

The plurality of individual magnet pieces (in the form of "plate-like" magnets) made of relatively high-grade magnetic material can be assembled on the magnet carrier 42. Rare earth magnets are examples of such plate-like magnets.

If corrosive media are to be pumped, the individual magnets (as magnet pieces) can additionally be coated or encapsulated. However, such magnets would be coated or encapsulated only if they come into physical contact with the pumped corrosive fluid. For the inner magnet 40 this is the case in all the embodiments. For the outer magnet 44 this is the case only when the pumping fluid flows around it as stator 48, without a hood-shaped cap 24.

The embodiment, described with reference to FIG. 5, of the production of the bearing carrier 22 by injection molding entails the omission of bearing pieces which would be added separately and the provision of bearing regions as "functional bearings". Three of these bearings (produced in one piece or in an integrated manner as bearings) are provided. Two of these bearing regions guide and support the shaft 10. A further one supports the outer rotor 80 of the micropump P.

The bearings can already be integrated during production by injection molding, without additional bearing components (referred to above as "bearing pieces") needing to be added. This embodiment is not shown separately, but can be understood by analogy.

The invention claimed is:

1. A pump arrangement comprising a micropump (P) for pumping a liquid and comprising a bearing carrier (22) as a base part, wherein an outer magnet (44) and an inner magnet (40) are provided and an outer rotating magnetic field of the outer magnet provides a rotary movement to the inner magnet attached to an axial shaft for rotating the micropump attached to the axial shaft (10), the pump arrangement further having three radial bearing pieces (1, 2, 3) providing rotational bearing support of the shaft (10) and the micropump (P) and positioned in the bearing carrier (22), one of the radial bearing pieces (3) rotatably supporting an outer rotor (80) of the micropump and being arranged eccentrically with respect to the axial shaft (10), and the two other radial bearing pieces (1,2) are axially spaced apart and rotatably support the axial shaft;

wherein one of the two radial bearing pieces rotatably supporting the shaft is arranged closer to the inner magnet (40) and the other one is arranged closer to the micropump, wherein both radial bearing pieces supporting the shaft stay spaced apart from one another;

and having a cover (26) arranged at an end of the bearing carrier, axially holding the micropump in the eccentric radial bearing piece;

a duct structure (23) for guiding a forced flow of liquid as main pressure side flow of the pumped liquid, the duct structure comprises at least a first and second duct portions (23*b*, 23*f*) in the cover (26) and first and second further axial duct portions (23*c*, 23*e*) in the bearing carrier (22) to flush or lubricate the radial bearing pieces supporting the shaft actively with a flow portion of the main pressure side flow of the pumped liquid and a hood-shaped cap (24), forming a hermetically sealed housing arrangement (20) comprising the bearing carrier, the hood-shaped cap and the cover (26), wherein the duct structure at the pressure side of the micropump provides for the main pressure side flow to cool the hood-shaped cap from an inside thereof.

2. The pump arrangement according to claim 1, wherein the outer magnet (44) and the inner magnet (40) form a magnetic torque transmission and a magnetic drive thus acts on the shaft (10) and an inner rotor (82) of the micropump (P).

3. The pump arrangement according to claim 2, wherein the inner magnet (40) is rotatably moved by a magnetic field produced by a rotating outer magnet arranged radially outside the inner magnet.

4. The pump arrangement according to claim 2, wherein the inner magnet is rotatably moved by a rotating magnetic field produced by a mechanically non-rotating outer stator in the form of a rotating field.

5. The pump arrangement according to claim 2, wherein the torque transmission is a central rotary coupling.

6. The pump arrangement according to claim 4, wherein the inner and outer magnets (44, 40) are arranged concentrically.

7. The pump arrangement according to claim 1, wherein the outer rotor (80) is an outer rotor of an annular gear pump (P) or an outer rotor of an internal gear pump.

8. The pump arrangement according to claim 1, wherein the inner magnet (40) is mounted on an inner magnet carrier (42).

9. The pump arrangement according to claim 8, wherein the inner magnet (40) having several parts.

10. The pump arrangement according to claim 9, wherein the parts are encapsulated by a casing or coating.

11. The pump arrangement according to claim 1, wherein the radial bearing pieces are joined to the bearing carrier by one of gluing, soldering and welding.

12. The pump arrangement according to claim 1, wherein the bearing carrier (22) is of metal or plastics material provided by injection molding.

13. The pump arrangement according to claim 12, in which at least one heating element (71, 72) is integrated in an injection-molded bearing carrier (22).

14. The pump arrangement according to claim 1, wherein the radial bearing pieces providing the bearings are separate precision components positioned and fixed in the bearing carrier (22) by a joining technology.

15. The pump arrangement according to claim 1, wherein maximum dimensions of the micropump (P) are not greater than 20 mm.

16. The pump arrangement according to claim 1, wherein the duct structure comprises a planar portion (23*d*) extending in a radial direction.

17. The pump arrangement according to claim 1, wherein the duct structure (23) guides the forced flow of liquid-as the main pressure side flow of the pumped liquid, and actively flushes and lubricates the radial bearing pieces supporting the shaft with the flow portion of the main pressure side flow of the pumped liquid.

18. A pump arrangement comprising a micropump (P) for pumping a liquid and comprising a bearing carrier (22) as a base part, wherein an outer magnet (44) and an inner magnet (40) are provided, to magnetically couple a rotary movement to the micropump (P) via an axial shaft (10), and wherein three radial bearings rotationally support the shaft (10) and the micropump (P) and are provided in the bearing carrier (22), one of the radial bearings (3) receiving and rotatably supporting an outer rotor (80) of the micropump and being arranged eccentrically with respect to the shaft (10) and the two other radial bearings (1,2) are axially spaced apart and rotatably support the axial shaft;

the bearing carrier (22) being of metal or plastics material made by injection molding and the radial bearings are provided integrated in the bearing carrier (22);

the micropump (P) is held in the eccentric radial bearing (3) by a cover (26) arranged at an end of the bearing carrier (22);

a duct structure for a forced flow is provided, having a first radially directed duct portion (23*b*) in the cover (26) and a second axially directed duct portion (23*c*, 23*e*) in the bearing carrier (22;

one of the radial bearings supporting the axial shaft is arranged closer to the inner magnet (40) and the other radial bearing supporting the axial shaft is arranged closer to the micropump (P).

19. The pump arrangement according to claim 18, wherein a hermetically sealed housing arrangement (20) is formed of the bearing carrier (22) and a hood-shaped cap (24) on the one hand and the cover (26) on the other hand, the pumped liquid cooling the hood-shaped cap (24) from an inside thereof via the duct structure.

20. The pump arrangement according to claim 18, wherein the duct structure for the forced flow comprises a further portion (23*e*) in the bearing carrier (22) and the at least two portions in the bearing carrier (22) extend substantially in an axial direction.

21. The pump arrangement according to claim 18, wherein yet another portion (23*b*) of the duct structure extends through the cover (26) and is positioned on a pressure side of the micropump.

22. The pump arrangement according to claim 18, wherein the duct structure comprises a planar portion (23*d*) extending in a radial direction.

23. A pump arrangement comprising a magnetically drivable micropump (P) for pumping a fluidic medium and comprising a bearing carrier (22) as a base part, wherein an outer magnet (44) and an inner magnet (40) are provided, magnetically coupling a rotary movement to the micropump (P) via an axial shaft (10), wherein the pump arrangement having a pressure side and a suction side; and wherein three radial bearings rotationally mounting the shaft (10) and the micropump (P) are provided in the bearing carrier (22), one of the radial bearings (3) receiving and rotationally supporting an outer rotor (80) of the micropump and being arranged eccentrically with respect to the shaft (10) and the two other radial bearings (1,2) are axially spaced apart and rotatably support the axial shaft;

the micropump (P) is held in the eccentric radial bearing (3) by a cover (26) arranged at the end of the bearing carrier;

a duct structure is provided at the pressure side of the micropump and having at least a first duct portion (23*b*) in the cover (26) and as a continuation thereof a second duct portion (23*c*, 23*e*) in the bearing carrier (22) for actively flushing or lubricating the two other radial bearings rotatably supporting the axial shaft by a portion of the pumped-fluidic medium.

24. The pump arrangement according to claim 23, wherein a hermetically sealed housing arrangement (20) is formed of the bearing carrier (22), a hood-shaped cap (24) and the cover (26), the pumped liquid for cooling the hood-shaped cap (24) from an inside via the duct structure.

25. The pump arrangement according to claim 24, wherein the hood-shaped cap (24) and the bearing carrier (22) are designed such that the pumped fluidic medium flows onto an inner surface of the cap (24) for cooling.

26. The pump arrangement according to claim 25, wherein more than 50% of the inner surface of the hood-shaped cap (24) is cooled.

27. The pump arrangement according to claim 23, wherein the bearing carrier comprises a concentric elevation or extension.

28. The pump arrangement according to claim 27, wherein the elevation or extension is formed in accordance with a hood-shaped cap and an annular space remains peripherally, wherein the inner magnet (40) axially protrudes, the axial length of which is longer than an axial length of the magnet carrier.

29. The pump arrangement according to claim 27, wherein the concentric elevation or extension carries at an end thereof one of the two other radial bearings and axially opposite thereof a magnet carrier is attached to the shaft (10) for rotation therewith.

30. The pump arrangement according to claim 23, wherein the duct structure for the forced flow comprises a further portion (23*e*) in the bearing carrier (22) and these at least two portions in the bearing carrier (22) extend substantially in an axial direction and are arranged with a circumferential offset from each other.

31. The pump arrangement according to claim 23, wherein the duct structure (23) guides the forced flow of liquid-as the main pressure side flow of the pumped liquid, and actively flushes and lubricates the two other radial shaft bearings rotatably supporting the axial shaft by a portion of the pumped fluidic medium.

32. A method for pumping a fluid, wherein a rotary movement is transmitted to a micropump (P) via an axial shaft (10) and comprising a pump arrangement, comprising the micropump (P) for pumping the fluid and comprising a bearing carrier (22) as a base part, wherein an outer magnet (44) and an inner magnet (40) are provided to transmit a rotary magnetic field to the micropump (P) for rotating the micropump via the axial shaft (10), and wherein three radial bearing pieces-providing a rotational bearing support of the shaft (10) and the micropump (P) and positioned in the bearing carrier (22), one of the radial bearings (3) rotatably supporting an outer rotor (80) of the micropump and being arranged eccentrically with respect to the shaft (10) and the two other radial bearing pieces (1,2) are spaced apart and rotatably support the axial shaft;

a cover (26) arranged at an end of the bearing carrier holds the micropump in the eccentric bearing (3);

a duct structure guiding a forced flow of the fluid, the duct structure comprises at least a first duct portion (23*b*) in the cover (26) and as a continuation thereof at least a first second duct portion (23*c*, 23*e*) in the bearing carrier for actively flushing or lubricating the shaft bearings with a portion of the pumped fluid;

one of the other two radial bearing pieces is arranged closer to the inner magnet (40) and the other radial bearing piece thereof is arranged closer to the micro-pump.

33. The pump arrangement according to claim 32, wherein the duct structure (23) guides the forced flow of liquid-as the main pressure side flow of the pumped liquid, and actively flushes and lubricates the shaft bearing with the portion of the pumped liquid.

* * * * *